US006267667B1

(12) United States Patent
Fikes

(10) Patent No.: US 6,267,667 B1
(45) Date of Patent: Jul. 31, 2001

(54) AIR DUCT EVACUATION SYSTEM

(76) Inventor: Jody Dewitt Fikes, 4502 Riosecove Dr., Rowlett, TX (US) 75088

( * ) Notice: Subject to any disclaimer, the term of this patent is extended or adjusted under 35 U.S.C. 154(b) by 0 days.

(21) Appl. No.: 09/399,389

(22) Filed: Sep. 20, 1999

(51) Int. Cl.[7] ..... F24F 7/007
(52) U.S. Cl. ..... 454/343; 454/236
(58) Field of Search ..... 454/343, 344, 454/339, 236

(56) References Cited

U.S. PATENT DOCUMENTS

| | | | | |
|---|---|---|---|---|
| 3,800,689 | | 4/1974 | Brown . | |
| 3,882,928 | | 5/1975 | Gazzo . | |
| 4,094,336 | | 6/1978 | Urschel et al. . | |
| 4,164,901 | | 8/1979 | Everett . | |
| 4,184,538 | | 1/1980 | Rauenhorst . | |
| 4,251,026 | * | 2/1981 | Siegel et al. | 234/49 |
| 4,765,231 | * | 8/1988 | Aniello | 454/343 |
| 4,776,385 | | 10/1988 | Dean . | |
| 4,838,150 | | 6/1989 | Suzuki et al. . | |
| 5,139,009 | | 8/1992 | Walsh . | |
| 5,415,001 | | 5/1995 | Gilmore et al. . | |
| 5,934,362 | | 8/1999 | Barker, II . | |

* cited by examiner

*Primary Examiner*—Harold Joyce
*Assistant Examiner*—Derek S. Boles

(57) ABSTRACT

A fan motor or blower unit attached and manufactured as part of the heating and cooling systems for homes and buildings or attached later to the furnace or air handler, which will vent out the HVAC ducts by removing the residing air. This air duct evacuation system will remove the unwanted warm or cool air from the building or structures air conditioning and heating duct systems, allowing for easier heating and cooling and more allergy friendly building or structure. The ADES will be on a relay switch or temperature controlled thermostat. The ADES will have a motor or blower unit able to pull the amount of the air per cubic feet per minute needed to vent the duct system. The main frame will have insulating stripping around the perimeter to prevent air leakage as well as a self closing and insulative exhaust flap doors. Surrounding the fan blades is a metal wire cage for safety of the blade operation. The optional feature or attachment will be a vent hose or duct which can be attached to the end of the ventilation system allow for the air to be piped to the exterior of the building or when the attachment is removed the air will be disburse into the attic or crawl space. The system will be automatically turned on by the thermostat or manually by the consumer.

18 Claims, 8 Drawing Sheets

INSULATED FLAP DOOR

AIR DUCT EVACUATION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

This invention/method relates to an exhaust fan or air ventilator, specifically to such ventilation systems which remove air from the Air conditioning (HVAC) ducts. This invention as best I can tell is in the Classification Definitions Class 454, sub-classes 230,233. Some prior art which may relate to this invention/concept is U.S. Ser. No. 04/776,385 Air Ventilation Control System. This unit appears to pull in the outside air then exhaust the air to the exterior. U.S. Ser. No. 05/934,362 Combination Bath Fan, Register Box, Air Conditioning and Heat Boot. This invention removes the air from a room and vents to the exterior. The Air Duct Evacuation System (ADES) will remove the air from the ducts and vent to the exterior, attic or crawl space.

BRIEF SUMMARY OF THE INVENTION

This invention will remove the air within the ducts of an air-condition/furnace (HVAC) system. The air is removed just minutes prior to the HVAC system cycling on so as to rid the air in the ducts, which has become either hot or cold while resting in the ducts of the buildings attic or crawl space.

In removal of the stagnate air in the ducts this will allow for cooler air (in the summer) or warmer air (in the winter) to reach the interior of homes or businesses faster. This will also mike for a more allergy friendly building.

DETAIL DESCRIPTION OF THE INVENTION

Figure 6:
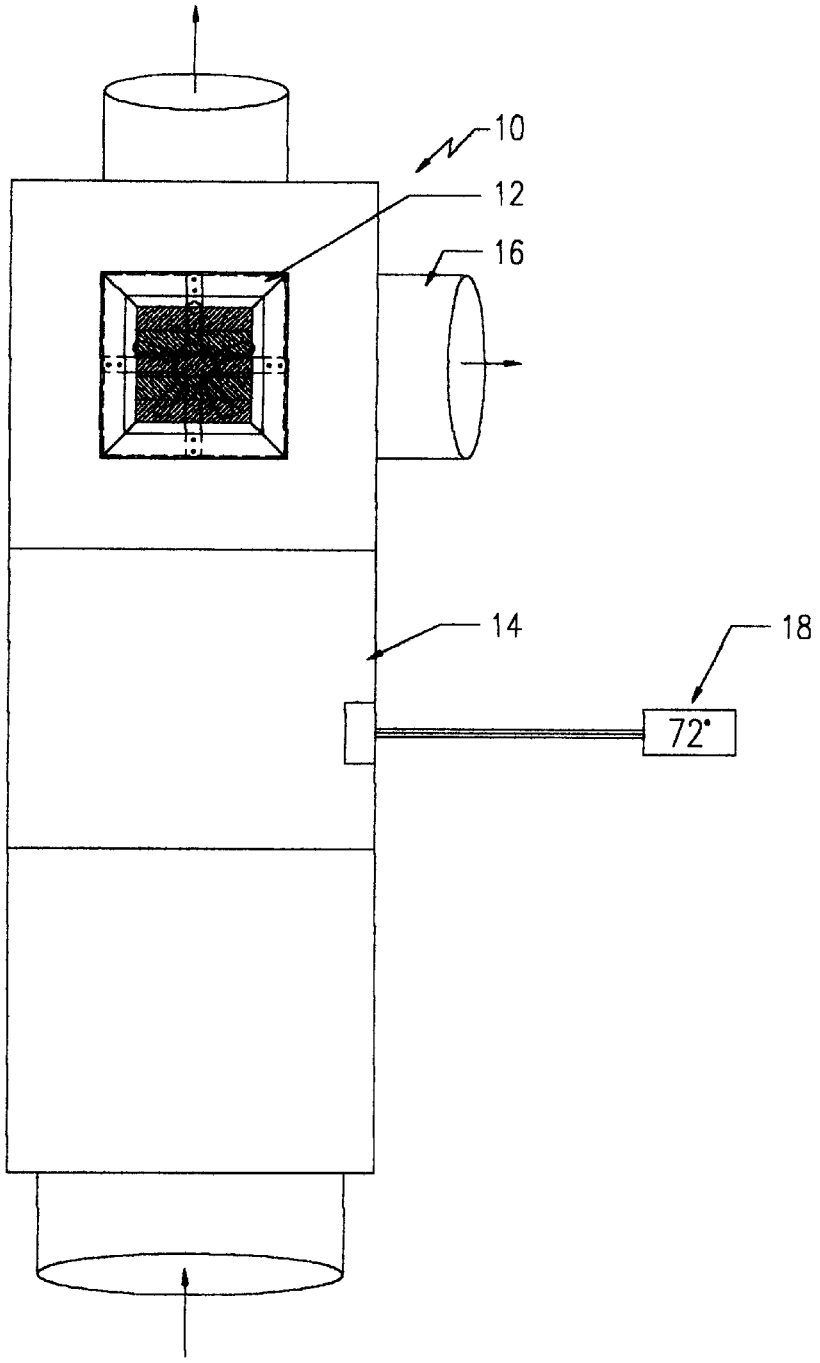
FIG. 6 shows a rendering of the air duct evacuation system as it appears on a vertical furnace.
Figure 7:
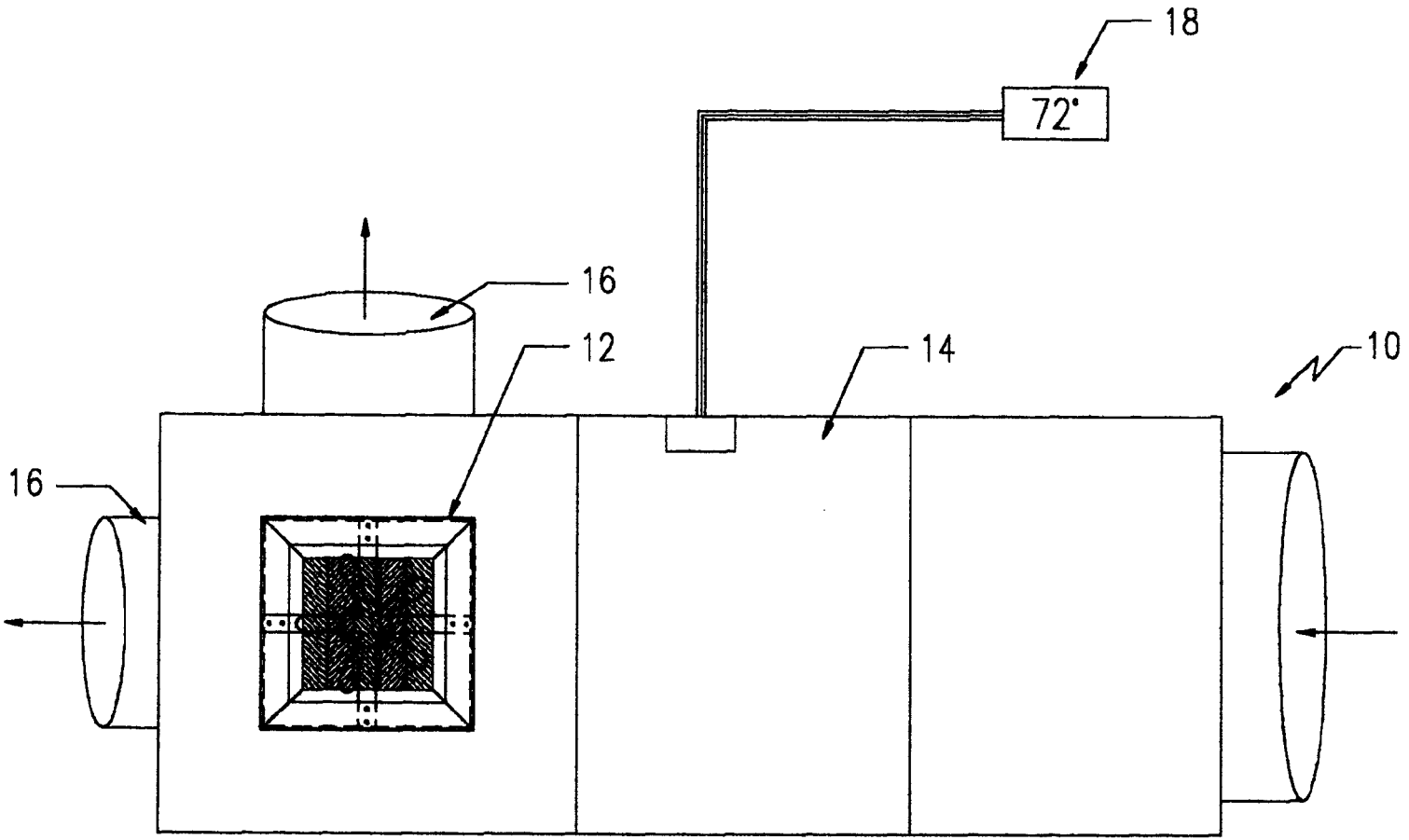
FIG. 7 shows a rendering of the air duct evacuation system as it appears on the horizontal furnace.
Figure 8:
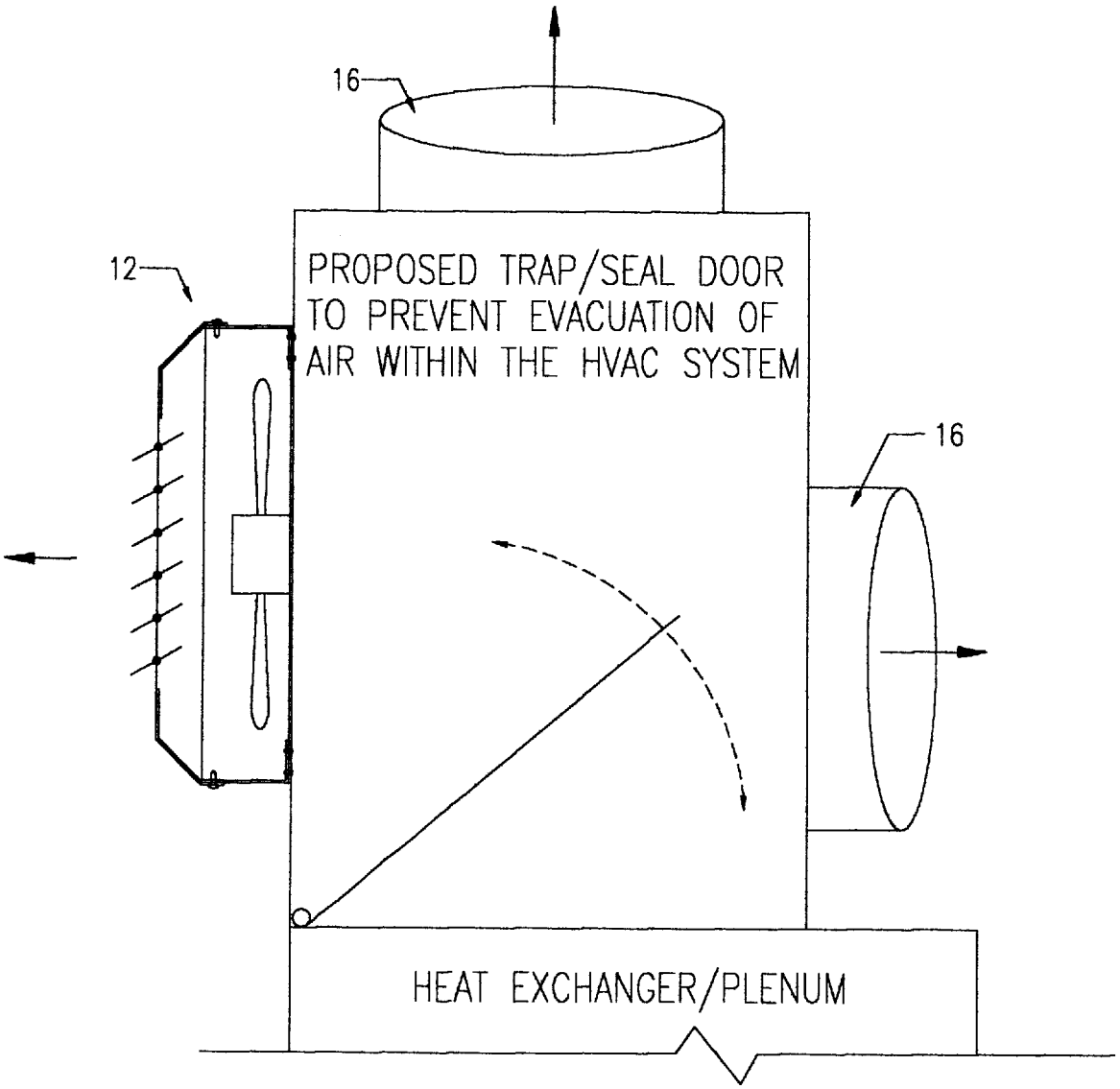
FIG. 8 shows an attachment seal door to prevent air from moving within the furnace unit while the air duct evacuation is in process.

This Air Duct Evacuation System (ADES) will be attached to the consumers furnace and or air handler just past the heat exchange, or on the last available position which to allow for close proximity to the existing ducts (FIGS. 6,7). The ADES will be on a relay switch from the thermostat or on a temperature control switch within the unit (FIGS. 6,7). The thermostat will call for the furnace or air handler to cycle on, the relay switch will be activated and only turn on the ADES system which will vent and remove the warm or cold air from the ducts. The process will take 1 minute or less, depending on the cubic air space of the ducts. Than the furnace or air handler will then cycle on blowing the desired air (cool or warm) into the building.

The goal here is to remove the air which has been in the ducts since the last cycle and has changed from its prior temperature. In the summer the cold air will begin to heat while resting in the ducts. By removing this cold air turned warm we prevent the warm air from blowing into the building ahead of the desired cold air, thus reducing the amount of air needed to cool or heat the building. Same holds true for the winter months and the warm air. The ADES will also allow for removal of dirty air in the ducts which will make for a more allergy friendly building.

Figure 1A:
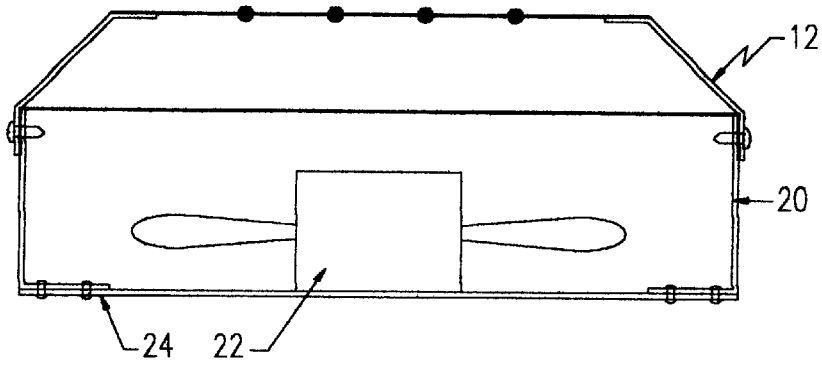
FIGS. 1*a* and 1*b* show a side view and a bottom view the air duct evacuation system ventilator, note the wire cage for safety and the bracing for the motor.
Figure 1B:
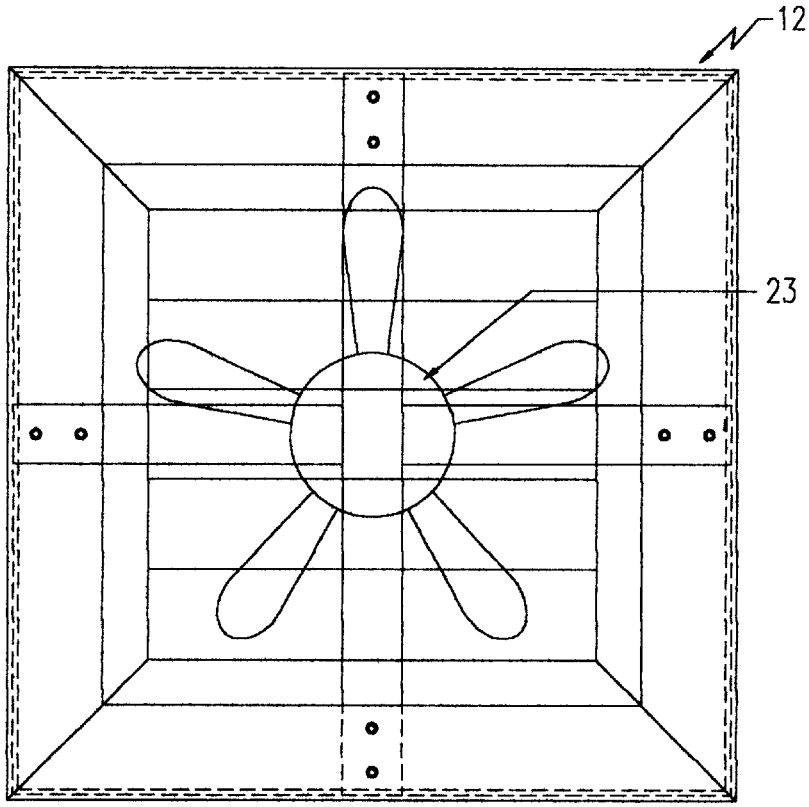
Figure 2A:
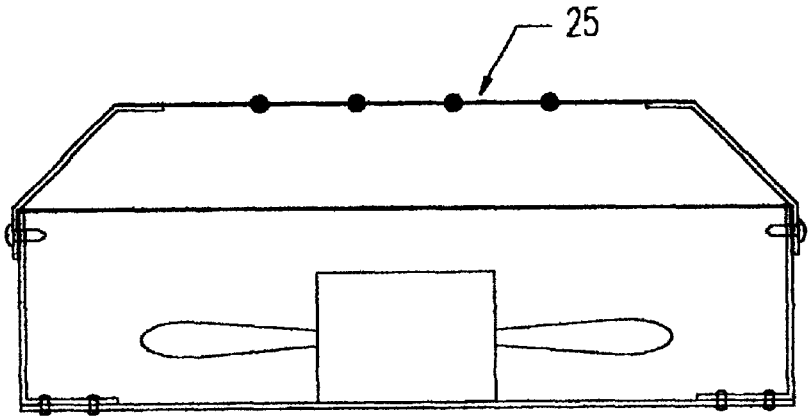
FIGS. 2*a*, 2*b* and 2*c* show 3 side views of the air duct evacuation system with the self closing/self sealing flap doors, closed view, opened view and closing view.
Figure 2B:
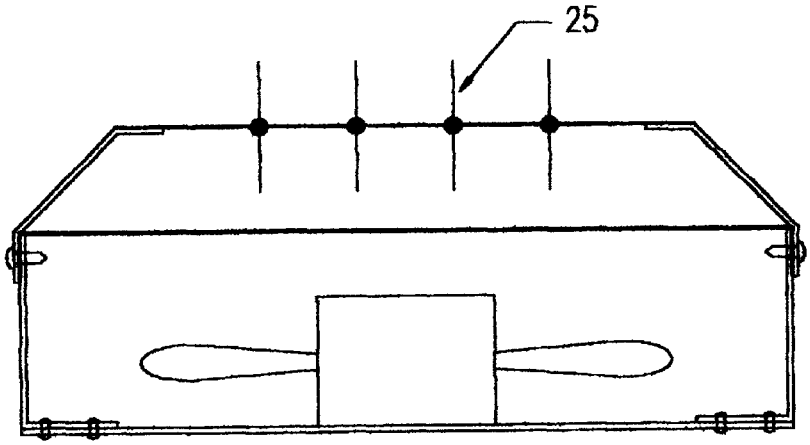
Figure 2C:
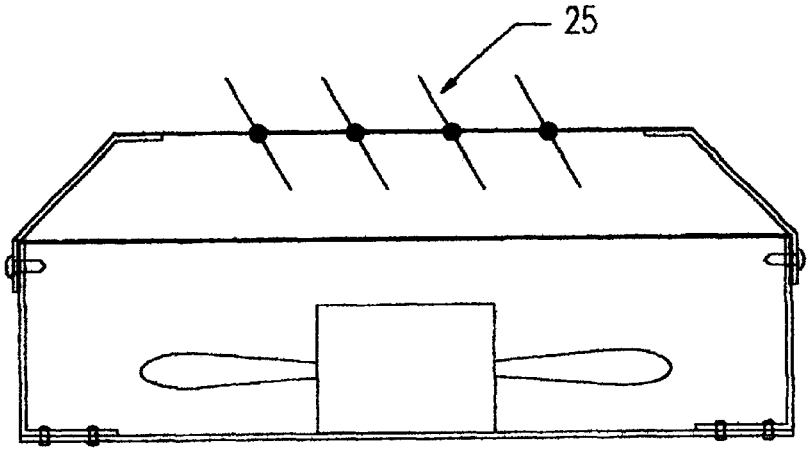
Figure 3A:
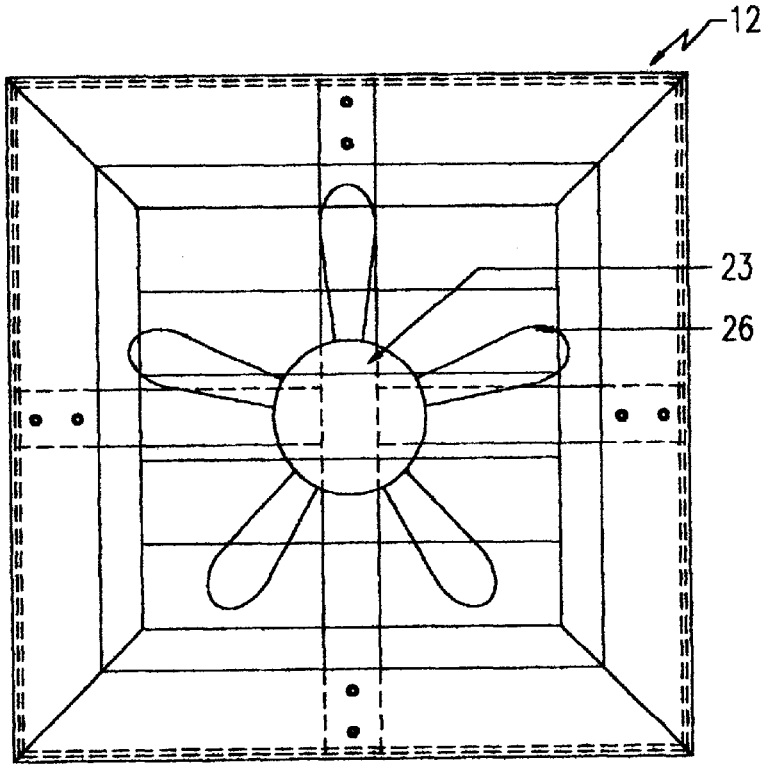
FIGS. 3*a* and 3*b* show 2 top views of the air duct evacuation system with the flap doors opened and closed.
Figure 3B:
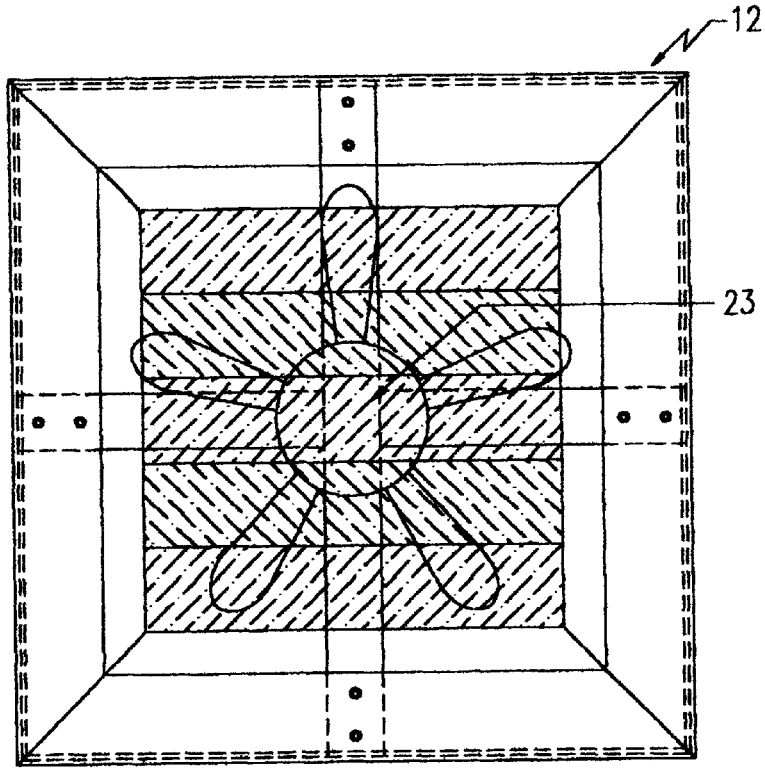
Figure 4:
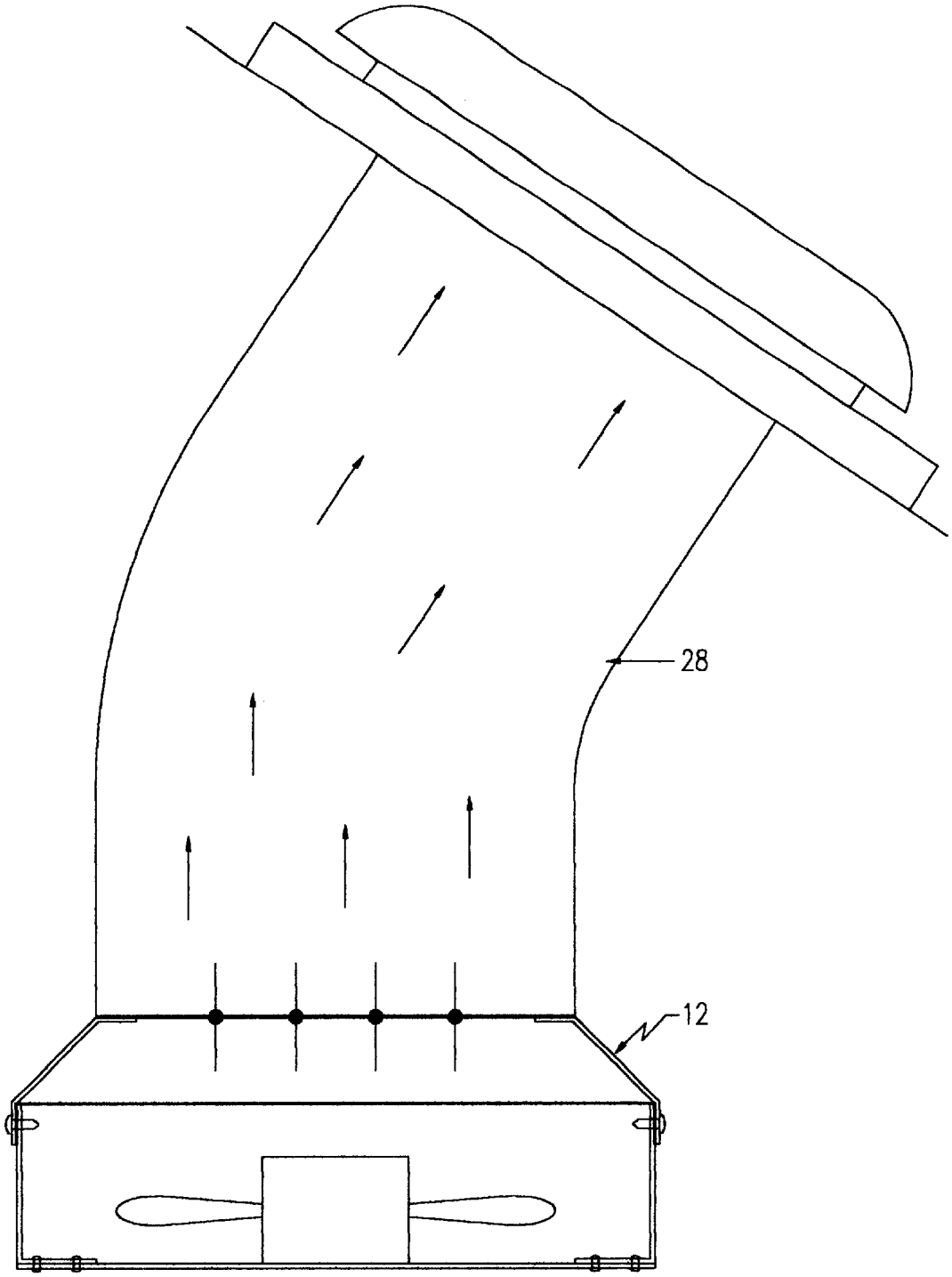
FIG. 4 shows a side view of the air duct evacuation system with the duct attachment allowing for complete air removal from the building.
Figure 5:
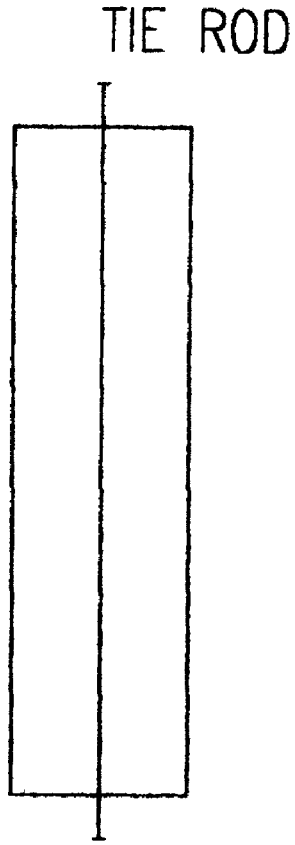
FIG. 5 shows a view of the door flap which is fully insulated.

The ADES will be a metal casing in the form of a square, rectangle or circle as shown in (FIG. 1). The ADES will have a motor with a fan attached or blower unit able to pull the amount of air per cubic feet per minute needed to vent the duct system (FIG. 1). The main frame and motor will be completely insulated and be coated or manufactured with a non corrosive metal ie . . . galvanized. The perimeter edges will have insulative stripping around were the ADES frame connects to the furnace. The ADES will have self closing and insulative exhaust flap doors (FIGS. 2,3,4). Surrounding the fan blades is a metal wire cage for safety of the blade operation (FIG. 1). The optional feature or attachment will be a vent hose or duct which can be attached to the end of the ventilation system allow for the air to be piped to the exterior of the building or when the attachment is removed the air will be disburse into the attic or crawl space (FIG. 4). The size of the ADES will be based on the air handler itself. Up to a 5 ton unit the size would be 9' to 1'6" in length by 1' wide and approximately 6" to 1' tall. The larger units may require an increase in size. An attachment called the trap/seal door can be added to prevent air from the unit itself being evacuated.

The ADES will be attached to the furnace or air handler securely so as to prevent noise and movement. The standard wiring from the ADES motor will run into the thermostat for automatic operation (FIGS. 6,7).

What is claimed is:

1. An air duct evacuation structure comprising:

an air handler for moving air through a duct system of a structure;

a control switch for enabling said air handler in response to an associated control signal;

an evacuation unit for evacuating the air from said duct system in response to said control switch enabling said air handler, wherein said control signal is a temperature and said control switch is a thermostat.

2. The air duct evacuation structure according to claim 1, wherein said evacuation unit is activated prior to enabling said air handler.

3. The air duct evacuation structure according to claim 1, wherein said evacuation unit comprises:

a fan for drawing said air from said duct system; and a motor for driving said fan.

4. The air duct evacuation structure according to claim 1, wherein said evacuation unit comprises a frame attached to said air handler, said frame a fan for drawing said air from said duct system; and a motor for driving said fan.

5. The air duct evacuation structure according to claim 4, wherein said frame further comprises flap doors for opening when drawing said air from said duct system.

6. The air duct evacuation structure according to claim 1, and further comprising:

an attachment attached to said evacuation unit for evacuating said air from said ducts to the outside of said structure.

7. The air duct evacuation structure according to claim 1, wherein said air is evacuated from said ducts and released into the air outside said ducts.

8. An air duct evacuation structure comprising:

a duct system of a structure for moving air through;

an evacuation unit for evacuating the air from said duct system in response to a control switch which switches in dependence upon an associated control signal, wherein said control signal is a temperature and said control switch is a temperature control switch.

9. The air duct evacuation structure according to claim 8, wherein said evacuation unit comprises:

a fan for drawing said air from said duct system; and a motor for driving said fan.

10. The air duct evacuation structure according to claim 8, and further comprising:

an air handler for moving air through said duct system; and, wherein said evacuation unit comprises a frame attached to said air handler, said frame housing:

a fan for drawing said air from said duct system; and a motor for driving said fan.

11. The air duct evacuation structure according to claim 10, wherein said frame further comprises flap doors for opening when drawing air from said duct system.

12. The air duct evacuation structure according to claim 8, and further comprising:

an attachment attached to said evacuation unit for evacuating said air from said ducts to the outside of said structure.

13. The air duct evacuation structure according to claim 8, wherein said evacuated air is evacuated from said ducts and released into the air outside said ducts.

14. A method of evacuating the air from a duct system comprising the steps of:

providing an air handler for moving air through a duct system of a structure;

enabling said air handler in response to a control signal applied to a control switch;

evacuating the air from said duct system prior to enabling said air handler in response to said control switch enabling said air handler, wherein said control signal is a temperature and said control switch is a thermostat.

15. The method of evacuating the air from a duct system according to claim 14, wherein said evacuation comprises the steps of:

driving a fan with a motor; and, drawing said air from said duct system with said fan.

16. The method of evacuating the air from a duct system according to claim 14, wherein said evacuation unit comprises a frame attached to said air handler, said comprising:

a fan for drawing said air from said duct system; and a motor for driving said fan.

17. The method of evacuating the air from a duct system according to claim 14, and further comprising the step of:

attaching an attachment to said evacuation unit for evacuating said air from said ducts to the outside of said structure.

18. The method of evacuating the air from a duct system according to claim 16 wherein said frame further comprises trap doors for opening when drawing said air from said duct system.

* * * * *

UNITED STATES PATENT AND TRADEMARK OFFICE

CERTIFICATE OF CORRECTION

PATENT NO. : 6,267,667
DATED : July 31, 2001
INVENTOR(S) : Jody Fikes

It is certified that error appears in the above-identified patent and that said Letters Patent is hereby corrected as shown below:

Title page,
Item [76], Inventors, please correct address to read -- 4502 Ridgecove Dr., Rowlett, TX (US) 75088. --

Column 1,
Line 40, delete “mike” and insert -- make --.

Column 2,
Line 39, delete “9’” and insert -- 1’ --.

Signed and Sealed this

Twenty-fifth Day of March, 2003

JAMES E. ROGAN
*Director of the United States Patent and Trademark Office*